US010633801B2

(12) United States Patent
Steiner

(10) Patent No.: US 10,633,801 B2
(45) Date of Patent: Apr. 28, 2020

(54) TAMPING UNIT AND METHOD FOR TAMPING A TRACK

(71) Applicant: Plasser & Theurer Export von Bahnbaumaschinen Gesellschaft m.b.H., Vienna (AT)

(72) Inventor: Ronald Steiner, Rabenstein an der Pielach (AT)

(73) Assignee: PLASSER & THEURER EXPORT VON BAHNBAUMASCHINEN GESELLSCHAFT M.B.H., Vienna (AT)

( * ) Notice: Subject to any disclaimer, the term of this patent is extended or adjusted under 35 U.S.C. 154(b) by 137 days.

(21) Appl. No.: 15/763,372

(22) PCT Filed: Oct. 19, 2016

(86) PCT No.: PCT/EP2016/001733
§ 371 (c)(1),
(2) Date: Mar. 26, 2018

(87) PCT Pub. No.: WO2017/084732
PCT Pub. Date: May 26, 2017

(65) Prior Publication Data

US 2018/0274178 A1 Sep. 27, 2018

(30) Foreign Application Priority Data

Nov. 18, 2015 (AT) ..... 742/2015

(51) Int. Cl.
*E01B 27/16* (2006.01)
*B06B 1/18* (2006.01)

(52) U.S. Cl.
CPC ..... *E01B 27/16* (2013.01); *B06B 1/18* (2013.01)

(58) Field of Classification Search
CPC ..... E01B 27/16
(Continued)

(56) References Cited

U.S. PATENT DOCUMENTS 3,000,327 A * 9/1961 Plasser et al. ..... E01B 27/16 104/12
3,653,327 A * 4/1972 Sauterel ..... E01B 27/16 104/12
(Continued)

FOREIGN PATENT DOCUMENTS

CH 597 522 A5 4/1978
CN 1525008 A 9/2004
(Continued)

OTHER PUBLICATIONS

International Search Report of PCT/EP2016/001733, dated Feb. 16, 2017.

*Primary Examiner* — Jason C Smith
(74) *Attorney, Agent, or Firm* — Collard & Roe, P.C.

(57) ABSTRACT

Provided in a tamping unit for tamping a track are squeezing drives (14) for a squeezing motion of tamping tines. In a hydraulic cylinder (19)—having a squeezing piston (17) with a piston rod (18)—of the squeezing drive (14), a first pressure chamber (20) for producing the squeezing motion (8) is provided. Additionally arranged is a second pressure chamber (21) for producing an opening motion directed opposite to the squeezing motion, and a third pressure chamber (22) provided for producing vibrations.

7 Claims, 1 Drawing Sheet

(58) Field of Classification Search
USPC ..... 104/12
See application file for complete search history.

(56) References Cited

U.S. PATENT DOCUMENTS

| | | | | | |
|---|---|---|---|---|---|
| 3,669,025 | A * | 6/1972 | Plasser | E01B 27/17 | 104/12 |
| 3,981,247 | A * | 9/1976 | Theurer | E01B 27/16 | 104/12 |
| 4,068,595 | A * | 1/1978 | Weber | B06B 1/18 | 104/12 |
| 4,218,978 | A * | 8/1980 | Pasquini | E01B 27/16 | 104/10 |
| 4,240,352 | A * | 12/1980 | Theurer | E01B 27/16 | 104/12 |
| 4,404,913 | A * | 9/1983 | Theurer | E01B 27/16 | 104/12 |
| 4,445,437 | A * | 5/1984 | Nielsen | E01B 27/16 | 104/12 |
| 4,942,821 | A * | 7/1990 | Rossanigo | E01B 27/16 | 104/12 |
| 9,677,639 | B2 | 6/2017 | Miyasato et al. | | |
| 2004/0163566 | A1 | 8/2004 | Theurer | | |
| 2006/0090666 | A1 | 5/2006 | Theurer et al. | | |
| 2017/0348731 | A1 * | 12/2017 | Hoefler | E01B 27/16 | |
| 2018/0202113 | A1 * | 7/2018 | Hoefler | E01B 27/16 | |
| 2018/0274178 | A1 * | 9/2018 | Steiner | E01B 27/16 | |
| 2018/0297081 | A1 * | 10/2018 | Philipp | E01B 27/16 | |

FOREIGN PATENT DOCUMENTS

| | | | |
|---|---|---|---|
| CN | 1526960 | A | 9/2004 |
| DE | 3523165 | A1 | 1/1987 |
| DE | 10 2007 061294 | A1 | 6/2009 |
| EP | 1 653 003 | A2 | 5/2006 |
| WO | 2013/190960 | A1 | 12/2013 |

* cited by examiner

TAMPING UNIT AND METHOD FOR TAMPING A TRACK

CROSS REFERENCE TO RELATED APPLICATIONS

This application is the National Stage of PCT/EP2016/001733 filed on Oct. 19, 2016, which claims priority under 35 U.S.C. § 119 of Austrian Application No. A 742/2015 filed on Nov. 18, 2015, the disclosures of which are incorporated by reference. The international application under PCT article 21(2) was not published in English.

The invention relates to a tamping unit according to the features cited in the introductory part of claim 1 as well as to a method of tamping a track, the known features of which are cited in the introductory part of claim 5.

EP 1 653 003 A1 discloses a tamping unit wherein, for tamping a track, tamping tines are moved towards one another in pairs. This squeezing motion for ballast compaction is carried out with the aid of a squeezing cylinder designed to be actuated hydraulically. A vibratory motion is hydraulically superimposed on the squeezing motion in order to thereby achieve easier penetration into the ballast as well as improved compaction.

It is the object of the present invention to provide a tamping unit and a method of the type mentioned at the beginning with which it is possible to reduce the energy expenditure for superimposing the vibrations in the squeezing drives.

According to the invention, this object is achieved with a tamping unit or a method of the specified kind by way of the features cited in the characterizing part of the main claims 1 and 5.

With a third pressure chamber of this kind it is possible to realize an advantageous separation between the pressure activation for the squeezing motion and the vibration amplitude superimposed thereon. As a result of the resulting addition of squeezing- and vibration impulse, lower pressures can be used, thus reducing the energy expenditure. In the case of encrusted ballast, it is possible with an increase of pressure to achieve a significantly higher impact force in the direction of the squeezing motion while maintaining the vibration amplitude.

Additional advantages of the invention become apparent from the claims and the drawing description.

The invention will be described in more detail below with reference to an embodiment represented in the drawing.

Figure 1:
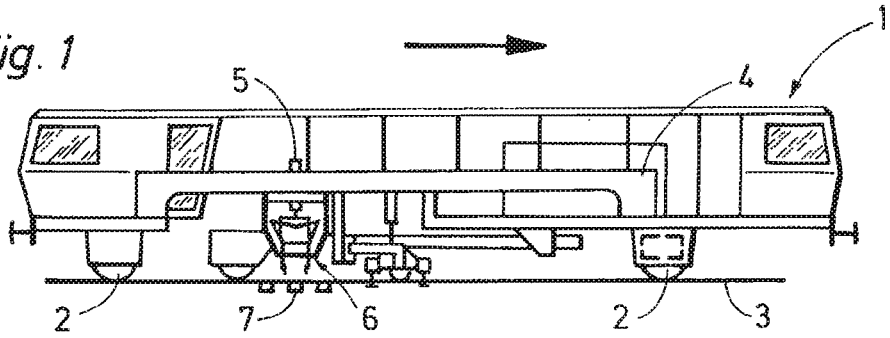
FIG. 1 shows a side view of a tamping machine with a tamping unit.

A tamping machine 1, shown in a simplified manner in FIG. 1, has a machine frame 4 mobile by means of on-track undercarriages 2 on a track 3. Arranged between the two on-track undercarriages 2 is a tamping unit 6, vertically adjustable by a drive 5, for tamping sleepers 7.

Figure 2:
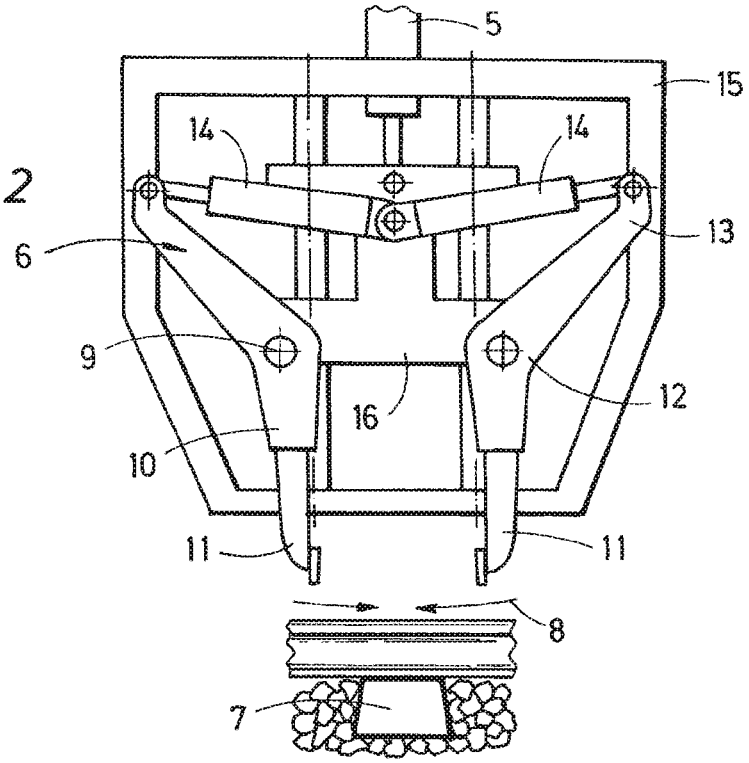
FIG. 2 shows an enlarged side view of the tamping unit having squeezing drives.

The tamping unit 6, shown enlarged in FIG. 2, has tamping levers 12 which, at a lower end 10, are connected to tamping tines 11 and are movable towards one another in pairs about a pivot axis 9 in a squeezing motion. At an upper end 13, said tamping levers 12 are connected in each case to a hydraulic squeezing drive 14 which is designed for carrying out both the squeezing motion 8 and a vibration superimposed thereon. Both tamping levers 12 and the squeezing drives 14 are supported on a carrier 16 which is vertically adjustable relative to an assembly frame 15 by means of the drive 5.

Figure 3:
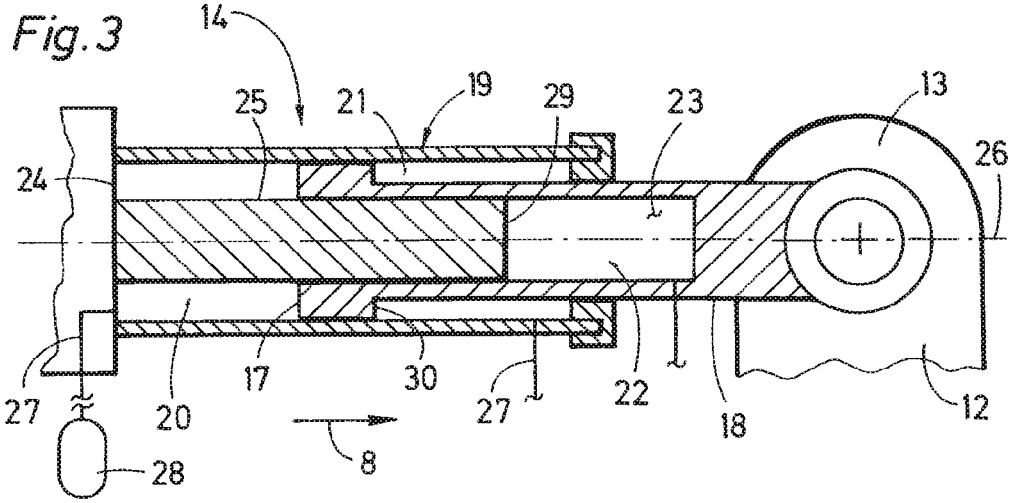
FIG. 3 shows a schematic cross-section of a squeezing drive.

As can be seen in FIG. 3, a first pressure chamber 20 for producing the squeezing motion 8 is arranged in a hydraulic cylinder 19—having a squeezing piston 17 with a piston rod 18—of the squeezing drive 14. A second pressure chamber 21 is provided at the piston rod side for an opening motion directed opposite to the squeezing motion 8.

A third pressure chamber 22, intended for producing vibrations, is formed by a cavity 23 arranged in the piston rod 18. This cavity 23 is delimited at the piston side by a second piston rod 25 fastened to a cylinder base 24 of the hydraulic cylinder 19. Both piston rods 18, 25 are arranged co-axially to a cylinder axis 26 of the hydraulic cylinder 19.

Hydraulic lines 27 are associated with each of the pressure chambers 20, 21, 22, wherein the hydraulic line 27 coupled to the first pressure chamber 20 is connected to an energy store 28 designed as a bladder accumulator. A piston surface 29 of the second piston rod 25 and a piston surface 30 of the squeezing piston 17 at the piston rod side have equal surface areas.

For tamping the sleeper 7, both tamping levers 12 are pivoted towards one another at a lower section about the pivot axis 9 by actuation in each case of the first pressure chamber 20 of each squeezing drive 14, as a result of which the tamping tines 11 are swivelled towards one another in the squeezing motion 8. After finishing the squeezing motion or the ballast compaction, the oppositely directed opening motion is accomplished by actuation of the second pressure chamber 21.

The squeezing- and opening motions of the tamping tines 11 are superimposed in each case by a preferably sinus-shaped vibration composed of two vibration amplitudes, wherein the first vibration amplitude effective in the direction of the squeezing motion 8 (see FIG. 3) is produced by a pressure impulse in the third pressure chamber 22. Thus, squeezing- and vibration powers add up in the squeezing motion which is very important for the ballast compaction or for breaking up encrusted ballast.

The second vibration amplitude effective in the opposite direction (in the direction of opening the tamping tines 11) is formed by a pressure impulse in the second pressure chamber 21.

The second vibration impulse causes a displacement of fluid from the first pressure chamber 20. The energy thus produced is intermediately stored in the energy store 28 and returned again into the first pressure chamber 20 with the actuation of the first vibration impulse.

The invention claimed is:

1. A tamping unit comprising:

a plurality of tamping tines;

tamping levers which, at a lower end, are connected to said plurality of tamping tines and are movable towards one another in pairs about a pivot axis in a squeezing motion;

a hydraulic squeezing drive, wherein said tamping levers are connected at an upper end to said hydraulic squeezing drive designed for carrying out the squeezing motion and a vibration superimposed thereon, wherein said hydraulic squeezing drive comprises:

a first pressure chamber for producing the squeezing motion, a second pressure chamber for producing an opening motion directed opposite to the squeezing motion, and a third pressure chamber for producing vibrations are arranged in a hydraulic cylinder—having a squeezing piston with a piston rod—of the squeezing drive.

2. The tamping unit according to claim 1, wherein the third pressure chamber is formed by a cavity, arranged in the piston rod, which is delimited at the piston side by a second piston rod fastened to a cylinder base of the hydraulic cylinder, wherein both piston rods are arranged co-axially to a cylinder axis of the hydraulic cylinder.

3. The tamping unit according to claim 2, wherein a piston surface of the second piston rod and a piston surface of the squeezing piston at the piston rod side have equal surface areas.

4. The tamping unit according to claim 1, wherein the first pressure chamber is connected to an energy store.

5. A method of tamping a track, comprising the following steps:

swiveling tamping levers, connected at a lower end to tamping tines and movable towards one another about a pivot axis, towards one another in a squeezing motion by actuation of a first pressure chamber; and opening said tamping levers in an oppositely-directed opening motion by actuation of a second pressure chamber, and superimposing a vibration on each of said two motions, wherein a first vibration impulse effective in the direction of the squeezing motion in each case is produced in a third pressure chamber.

6. The method according to claim 5, further comprising the step of producing a second vibration impulse effective in the direction of the opening motion in the second pressure chamber.

7. The method according to claim 6, wherein the energy produced by the second vibration impulse and by the fluid displacement, thus caused, from the first pressure chamber is intermediately stored in an energy store and returned again into the first pressure chamber with the actuation of the first vibration impulse.

* * * * *